US005457913A

United States Patent [19]

Gold

[11] Patent Number: 5,457,913

[45] Date of Patent: Oct. 17, 1995

[54] HINGE MOUNTING FOR AUTO VENTILATION WINDOW

[76] Inventor: Peter Gold, 389 Peninsula Blvd., Hempstead, N.Y. 11550

[21] Appl. No.: 231,046

[22] Filed: Apr. 22, 1994

[51] Int. Cl.[6] ..... E05D 15/00

[52] U.S. Cl. ..... 49/381; 49/397

[58] Field of Search ..... 49/381, 400, 401, 49/394, 147, 397; 16/225, 226; 296/201, 146.16

[56] References Cited

U.S. PATENT DOCUMENTS

| | | | |
|---|---|---|---|
| 2,507,965 | 5/1950 | Eichner | 49/147 X |
| 3,521,403 | 7/1970 | Bouwkamp | 296/146.16 X |
| 3,974,753 | 8/1976 | Blomgren et al. | 49/397 X |
| 4,130,966 | 12/1978 | Kujawa et al. | 49/397 X |
| 4,363,191 | 12/1982 | Morgan | 49/381 |
| 4,638,598 | 1/1987 | Gold | 49/394 |

*Primary Examiner*—Jerry Redman

[57] ABSTRACT

An auto ventilation side window in a recessed opening to minimize adverse aerodynamic wind resistance, in which the flange periphery which bounds the recess is advantageously used also as a flexturing support for an opening pivotal traverse of the window, the angle of the traverse being confined to an extent that does not result in a rupturing of the construction material of the window-supporting flange.

2 Claims, 2 Drawing Sheets

HINGE MOUNTING FOR AUTO VENTILATION WINDOW

FIELD OF INVENTION

The present invention relates to improvements in auto ventilation windows, i.e. windows on the sides of the auto, van or the like, which windows cannot project during use beyond a controlled pivotal traverse since such degree of movement is into the path of movement of a passing auto and/or pedestrian, and consequently would create a safety hazard, the improvements more particularly residing in the mounting of such windows to partake of the controlled pivotal traverse for the ventilation purposes intended.

BACKGROUND

Restricted pivotally movable windows in autos are already well known, as exemplified by my prior U.S. Pat. No. 4,638,598 issued on Jan. 27, 1987 for "Force Hinge Connection For The Latching Mechanism Of A Panel Truck Or Van Window", and in U.S. Pat. No. 4,363,191 issued on Dec. 14, 1982 to Cleon C. Morgan, in both of which the proposed improvements are in the movement-controlling means that restrict the extent of the pivotal traverse of the windows. The windows otherwise, and as is pertinent to the within invention, use conventional hinges which provide or allow for the traversing degree of movement of the windows, and such hinges are unnecessary costly and more complicated than need be, given the circumstances of the operating mode of the windows.

SUMMARY OF THE INVENTION

Broadly, it is an object of the present invention to embody greater simplicity in the hinge mounting of an auto ventilation window, thereby overcoming the foregoing and other shortcomings of the prior art.

More particularly, it is an object to obviate any need whatsoever of a hinge in the mounting of the window, but to achieve the pivotal traversing degree of window movement using to advantage the construction materials of the auto bounding the window opening, all as will be better understood as the description proceeds. Stated otherwise, underlying the present invention is the recognition that the window opening movement is limited or restricted for the safety reasons noted, and that construction materials are available to be selected for the peripheral boundary of the window opening that have a flexturing mode within the parameters of this restricted movement, such that attachment of the window to this flexturing component effectively provides, without attendant rupture, the equivalent of the hinge function.

The description of the invention which follows, together with the accompanying drawings should not be construed as limiting the invention to the examples shown and described, because those skilled in the art to which this invention appertains will be able to devise other forms thereof within the ambit of the appended claims.

DETAILED DESCRIPTION OF THE INVENTION

Figure 2:
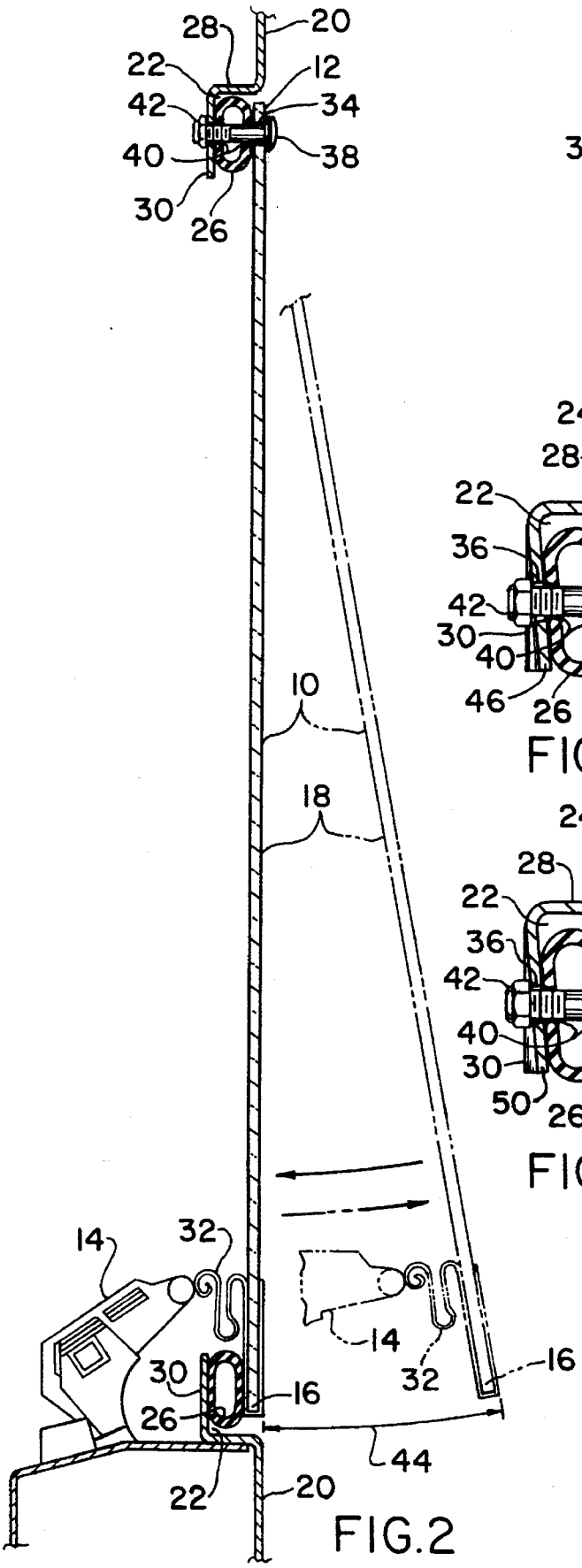
FIG. 2 is a cross sectional view taken along line 2—2 of FIG. 1 illustrating in full line and phantom line perspective the pivotal traverse of the window permitted by the inventive hinge.

The auto ventilation window 10 of the present invention is of the rectangular type that is typically hingedly fixed along its upper edge 12 and mechanically latched closed and released for a pivotal traverse by a latch mechanism, generally designated 14, at its lower edge 16, said mechanism 14 being illustrated and described in U.S. Pat. No. 4,638,598 issued on Jan. 27, 1987 which, by this reference, is incorporated herein in its entirety. Latch mechanism 14 allows for limited opening of window glass panel 18 as best shown in FIG. 2. In accordance with aerodynamic principles, when window 10 is in its closed position, the mounting of the window glass panel 18 is designed to maintain the panel flush with the plane of the auto body 20. To this end, a depression or recess 22 is provided in the body panel 20, 24 bounding the window opening, which recess is deep enough to accommodate panel 18 and a cooperating weather seal 26. Recess 22 is formed of a peripheral set back wall 28 and a marginal internal flange 30 parallel to body plane 20. Weather seal 26 is cemented or otherwise secured to flange 30. Latch 14 is of the over-the-center type having a serpentine leaf spring 32 as fully described in the referenced '598 patent.

In the present invention, and as seen in FIG. 2, glass panel 18 is provided with at least a pair of holes 34 which are strategically located to align with cooperating bolt holes 36 in the top length portion of the marginal flange 30. Bolts 38 are in practice projected through aligning holes 40 in weather seal 26 as well as through slightly oversized holes 34 and 36. Bolts 38 are secured by lock nuts 42 when seal member 26 is under slight compression.

Figure 1:
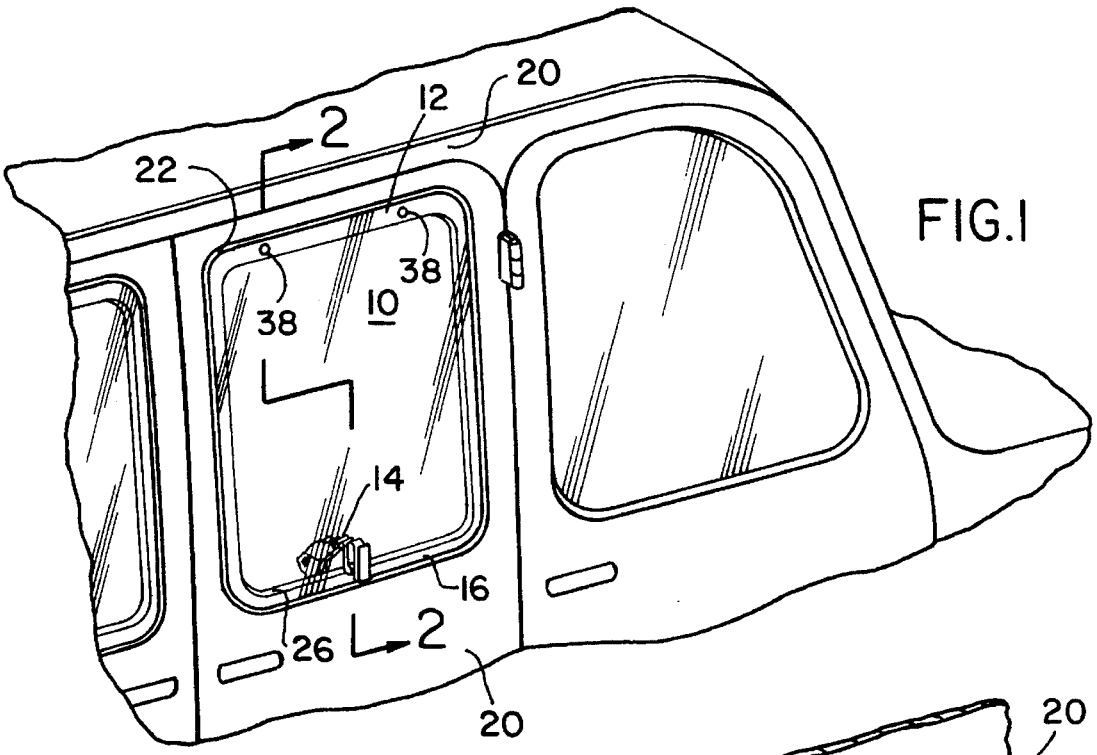
FIG. 1 is a partial perspective view of an auto illustrating typical use of the within inventive hinged ventilation window.
Figure 3:
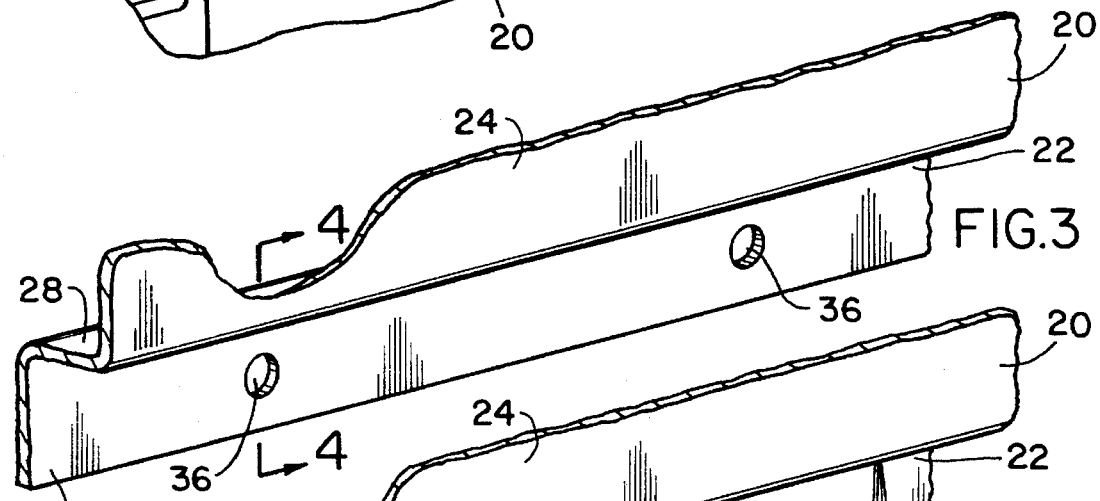
FIG. 3 is a partial perspective of a first embodiment of a hinge-supporting component.
Figure 4:
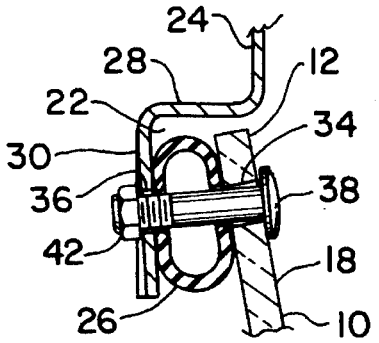
FIG. 4 is a cross sectional view taken along line 4—4 of FIG. 3.

The within inventive hinge for mounting window glass 18 for the limited pivotal traverse depicted in FIG. 2 is illustrated in a greatly simplified construction as a first embodiment, as more particularly shown in FIG. 3. That is, the upper marginal flange 30 is formed as has already been described, and holes 36 are then added. When window 10 is assembled as shown in FIG. 2, and latch means 14 is moved to the open position, window 18 has an approximate 10° movement counterclockwise, as noted by angle 44, about bolts 38. About an effective hinge axis, the initial movement of panel 18 will flex weather seal 26 and, if need be, displace flange 30 nominally as seen in the "open" position of movement depicted in FIG. 4. Upon closure of window 10, upper marginal flange 30 will assume its starting position of movement without rupture having occurred, said starting or initial position of movement being depicted in full line perspective in FIG. 2.

Figure 5:
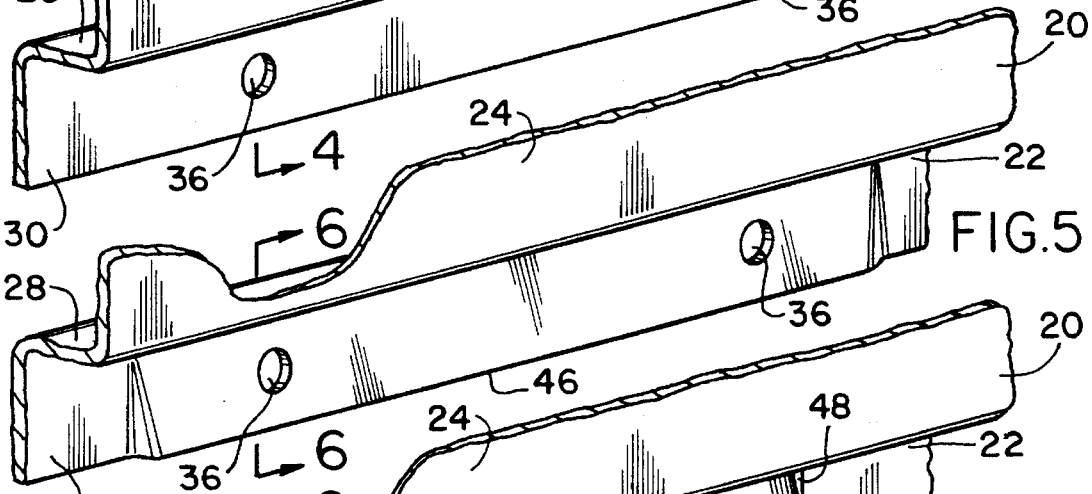
FIG. 5 is similar to FIG. 3 illustrating, as a partial perspective view, a second embodiment of a hinge-supporting component.
Figure 8:
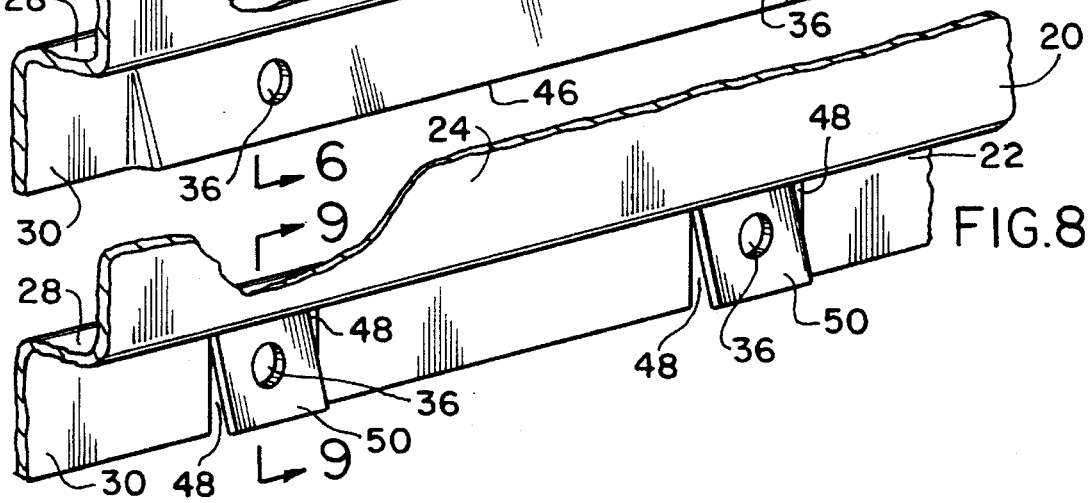
FIG. 8 is a partial perspective view of a third embodiment of a hinge-supporting component.

Underlying the present invention, as to the FIG. 3 window hinge mount, as well as to the variations of FIGS. 5 and 8 soon to be described, is the recognition that the plastic or springy metal construction material of support 26 (FIG. 4), support 46 (FIG. 5) and support 50 (FIG. 8) have a flexturing mode that will allow a limited pivotal traverse without rupture. This is used to advantage since the pivotal traverse is kept within the construction material non-rupturing parameters by the latch mechanism 14, and the angular size of the pivotal traverse that is permitted or occurs in practice is adequate for the ventilation of the auto, and thus contributes to the use of the window 10 for the purposes intended. Stated otherwise, window 10 is hingedly mounted according to the present invention without the use of a hinge or pivot mechanism 42 of the prior art '598 patent and all other known prior art patents.

Figure 6:
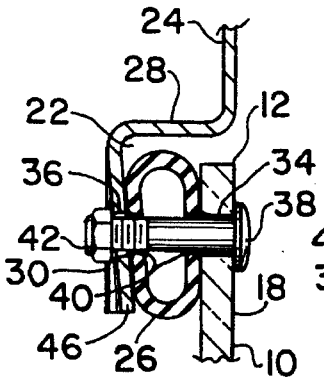
FIG. 6 is a cross sectional view taken along line 6—6 of FIG. 5, but showing the hinged window in a closed position.
Figure 7:
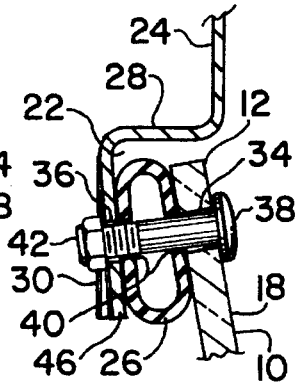
FIG. 7 is, like FIG. 6, a cross sectional view, but showing the hinged window in an open position.

In the hinge mounting variation of FIG. 5, the length portion or section of flange 30 between and immediately adjacent holes 36, designated 46, is prebent outward 5° counterclockwise out of the plane of flange 30. Panel 18, weather seal 26 and latch 14 with bolts 38 are assembled as before described to section 46. This prebent section 46 contributes to diminishing the stresses that unavoidable develop, but do not produce rupture, about the hinge axis by, in effect, splitting the difference in deflections of strip 26 and upper flange 30, between the fully closed and fully open positions of movement depicted respectively in FIGS. 6 and 7.

Figure 9:
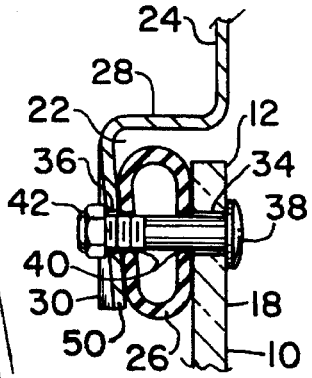
FIG. 9 and FIG. 10, like FIGS. 6 and 7, are respective closed and opened positions of the within inventive hinged window.
Figure 10:
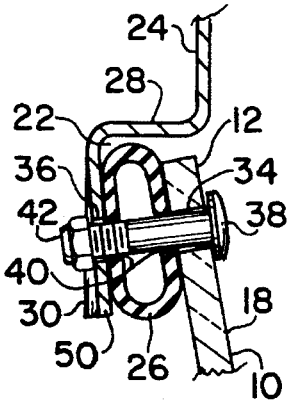

In yet another third embodiment as seen in FIG. 8,1 the upper flange 30 is cut or notched at points 48 adjacent holes 34 to form two tabs 50, each spaced slightly inward of the opposite ends of the flange 30. Tabs 50 are then bent outward, similarly to section 46 of the second embodiment. The use of isolated tabs 50 has a like effect of minimizing deflections and stresses at the hinge axis, when partaking of the limited pivotal traverse of FIGS. 9 and 10.

While the auto window hinge mounting embodiments herein shown and disclosed in detail are fully capable of attaining the objects and providing the advantages hereinbefore stated, it is to be understood that they are merely illustrative of presently preferred embodiments of the invention and that no limitations are intended to the detail of construction or design herein shown other than as defined in the appended claims.

What is claimed is:

1. An improved hinge mounting for a movable window provided for ventilation of an auto comprising a window opening bounded by a four-sided frame of selected construction material characterized by a limited extent of flexturing through a pivotal movement without rupturing, cooperating spaced-apart two slots each adjacent an opposite side of said window frame delineating a window-hinging section therebetween, a rectangular auto window attached along a top side to said hinging section to partake of a pivotal movement between open and closed positions in said window opening, and movement-limiting link means connected in spanning relation between an opposite bottom side of said window frame and said bottom side of said window, whereby said window is prevented from partaking of a pivotal movement of an extent rupturing said window frame side but not from assuming a window-opening position of a lesser extent suitable for ventilation.

2. An improved hinge mounting for a movable window provided for ventilation of an auto comprising a window opening bounded by a four-sided frame of selected construction material characterized by a limited extent of flexturing through a pivotal movement without rupturing, cooperating two spaced-apart slots in each opposite side of said window frame delineating corresponding two hinging tabs therebetween, a rectangular auto window attached along a top side to said hinging tabs to partake of a pivotal movement between open and closed positions in said window opening, and movement-limiting link means connected in spanning relation between an opposite bottom side of said window frame and said bottom remote side of said window, whereby said window is prevented from partaking of a pivotal movement of an extent rupturing said window frame side but not from assuming a window-opening position of a lesser extent suitable for ventilation.

* * * * *